US008387539B1

(12) United States Patent
Maines

(10) Patent No.: US 8,387,539 B1
(45) Date of Patent: Mar. 5, 2013

(54) SCULPTED REACTIVE LINER WITH SEMI-CYLINDRICAL LINEAR OPEN CELLS

(75) Inventor: Warren R. Maines, Pensacola, FL (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 104 days.

(21) Appl. No.: 12/776,739

(22) Filed: May 10, 2010

(51) Int. Cl.
*F42B 12/22* (2006.01)

(52) U.S. Cl. ..... 102/493; 102/491; 102/494

(58) Field of Classification Search ..... 102/491–497, 102/473, 517
See application file for complete search history.

(56) References Cited

U.S. PATENT DOCUMENTS

| | | | | | |
|---|---|---|---|---|---|
| 2,264,791 | A * | 12/1941 | Fries | 102/372 |
| 3,156,188 | A * | 11/1964 | Zernow et al. | 102/491 |
| 3,491,694 | A * | 1/1970 | Fountain | 102/493 |
| 3,566,794 | A * | 3/1971 | Pearson et al. | 102/493 |
| 3,731,633 | A * | 5/1973 | Davis | 102/495 |
| 3,799,054 | A * | 3/1974 | LaRocca | 102/491 |
| 4,089,267 | A * | 5/1978 | Mescall et al. | 102/491 |
| 4,108,073 | A * | 8/1978 | Davis | 102/518 |
| 4,722,280 | A * | 2/1988 | Sanai | 102/289 |
| 4,815,386 | A * | 3/1989 | Dillard et al. | 102/364 |
| 4,996,923 | A * | 3/1991 | Theising | 102/438 |
| 5,131,329 | A * | 7/1992 | Lips et al. | 102/364 |
| 5,337,673 | A * | 8/1994 | Koontz et al. | 102/491 |
| 6,481,356 | B2 * | 11/2002 | Gualandi | 102/439 |
| 6,857,372 | B2 * | 2/2005 | Renaud-Bezot et al. | 102/493 |
| 7,117,797 | B2 * | 10/2006 | Biserod et al. | 102/288 |
| 7,121,211 | B2 * | 10/2006 | Beal | 102/514 |
| 7,373,887 | B2 * | 5/2008 | Jackson | 102/517 |
| 7,383,775 | B1 * | 6/2008 | Mock et al. | 102/363 |
| 7,886,667 | B1 * | 2/2011 | Baker et al. | 102/495 |
| 7,966,937 | B1 * | 6/2011 | Jackson | 102/517 |
| 8,015,924 | B1 * | 9/2011 | Maines et al. | 102/492 |
| 2005/0087088 | A1 * | 4/2005 | Lacy et al. | 102/495 |

* cited by examiner

*Primary Examiner* — Michael David
(74) *Attorney, Agent, or Firm* — AFMCLO/JAZ; Bart S. Hersko

(57) ABSTRACT

Bombs lined with reactive liners that improve the blast and fragmentation of the bombs is disclosed. The effect is caused by the Richtmyer-Meshkov instability which is introduced at the explosive/reactive liner interface by introducing semi-cylindrical open linear cells between the reactive liner and the explosive that are void. This geometry produces a turbulent flow effect which readily mixes the reactive liner when accelerated by the grazing shock wave generated during detonation, which moves through the liner and case material. The geometry produces the added effect of creating faster and more plentiful fragments that are lighter in mass than those produced by typical bombs that are annularly lined with reactive liners, while maintaining insensitive munitions capability.

15 Claims, 2 Drawing Sheets

SCULPTED REACTIVE LINER WITH SEMI-CYLINDRICAL LINEAR OPEN CELLS

RIGHTS OF THE GOVERNMENT

The invention described herein may be manufactured and used by or for the Government of the United States for all governmental purposes without the payment of any royalty.

BACKGROUND OF THE INVENTION

The invention is based on methods of controlling fragmentation by inserting plastic surrounds in the generic bomb or warhead. The invention is similar to the active surround. The bomb is composed of an Advanced Energetic Composite material and is also engineered for maximum energetic release upon detonation.

While reactive liners enhance the blast of high brisance explosives, the first problem is that they are inefficient. The chemical constituents mix behind the shocked air, which is known to have a low concentration of available oxygen. Therefore, the only mechanism with which the reactive liner can enhance blast is through shear induced mixing typically encountered by a reflecting surface.

The second problem with reactive liners is that they reduce the specific kinetic energy to the case wall due to impedance mismatch and additional mass. This subsequently increases the specific impulse. This causes large and slower moving fragments.

The present invention solves both problems. It has been shown to create shear induced mixing in the form of a Richtmyer-Meshkov instability which enhances blast without the need for ground reflections. It also creates a higher concentration of faster moving fragments than a typical annularly lined bomb by providing variations in the liner mass.

The additional benefit is that reactive liners are known to make munitions insensitive to sympathetic detonation, bullet impact, fragment impact, and shaped charge impact. This is again, due to the fact that the liner provides an impedance layer between the explosive and the warhead case, which reduces the shock imparted into the explosive from outside insults.

SUMMARY OF THE INVENTION

The present invention enhances the blast of a lined warhead by mixing the reactive liner earlier in time than an annularly lined generic warhead upon detonation. This is accomplished by notching the reactive liner along its interior surface with semi-cylindrical linear open cells that form voids in the reactive liner. The voids are concave toward the explosive.

The invention increases the ejection velocity of the fragments via impendence matching, shocked fluid instability and multi phase reactive flow. The semi-circular voids create enough stress diffusion to allow the case to expand to 95% of its natural limit and yet, create enough stress concentrations to govern case fragmentation. The fragments are not as well formed as those created by other plastic liners, such as wedges, but they are faster moving, and more abundant due to the fact that gases inside the case remain under pressure for a longer duration of time.

DETAILED DESCRIPTION OF THE INVENTION

The present invention describes a blast enhancing reactive liner for a general purpose bomb containing an explosive. The reactive liner has reversed notches that comprise semi-cylindrical linear open cells forming semi-cylindrical linear open voids in the blast enhancing reactive liner. In one embodiment, the semi-cylindrical linear open voids in the blast enhancing reactive liner are concave to the explosive. In a preferred embodiment, the semi-cylindrical linear open voids in the blast enhancing reactive liner are placed at the interface of the liner and the explosive. In one embodiment, the reactive liner is made from metal or metal oxide particles suspended in a thermoplastic matrix using melt casting techniques.

The present invention also describes bombs containing a blast enhancing reactive liner. The bombs comprise a casing wall, a blast enhancing reactive liner lining the casing wall, and an explosive encased by the reactive liner.

Figure 1:
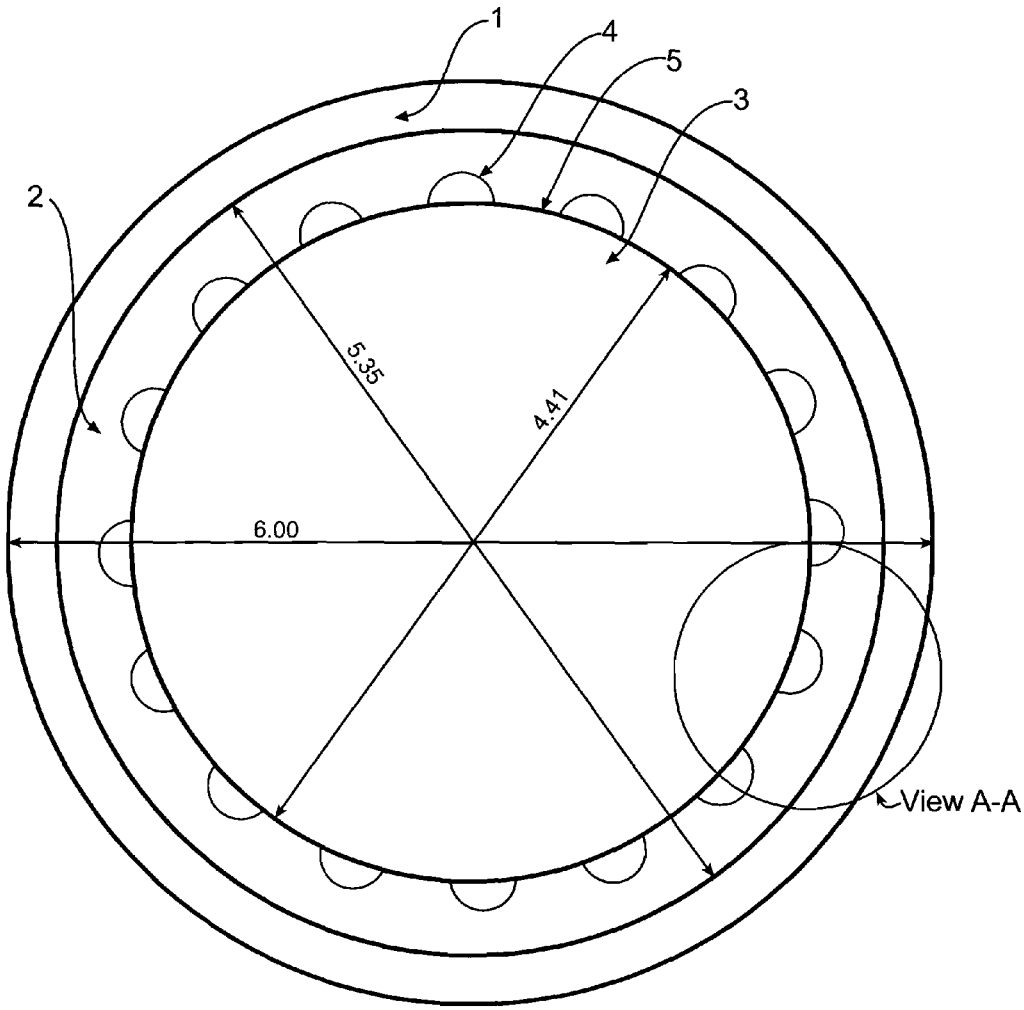
FIG. 1 is an axial cross-section of a generic warhead, which details the sculpted reactive liner.
Figure 2:
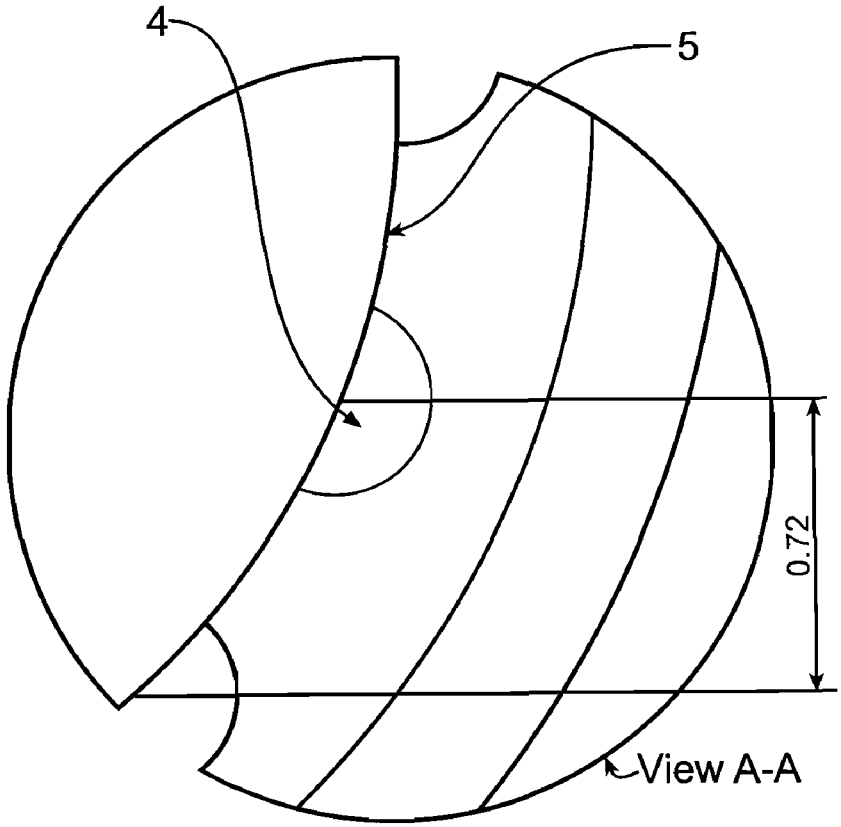
FIG. 2 is a perspective view in partial cross section of the circular area designated as View A-A on FIG. 1.

FIG. 1 shows the cross sectional view of the warhead: steel case [1], the reactive liner [2], and the explosive [3]. As shown in FIG. 2, the reactive liner [2] is sculpted along its interior surface with semi-cylindrical open linear cells that form voids [4] in the reactive liner [2], which is the crux of the invention. The contact points [5] are at the explosive-reactive liner interface. The invention is currently manufactured by melt casting techniques. The steel case [1] is heated to the melting temperature of the reactive liner [2], which occupies 10% of the volume of the bomb. Hot reactive liner is poured into the empty case. The open end of the case is then capped (not shown). The item is heated to about 86° Celsius in a suitable convection oven. The item is removed from oven after 30 minutes and placed on a lathe and rotated at 100 revolutions per minute until the steel case and liner are at room temperature. After the capped end is opened, the reactive liner [2] is machined such that the semi-cylindrical open linear cellular voids [4] are evenly spaced between the contact points [5] with the explosive [3]. Currently, the voids are individually machined by repetitively shaving thin layers of material using a sharpened cylindrical bit. One tenth of an inch of material is removed per pass as it slowly runs the length of the liner. Other techniques could be used, such as routing. After machining, the explosive core is slip fit into the warhead, as is a common practice for advanced warheads.

The invention advances the current state of the art in reactive liner systems, which typically consist of metal and/or metal oxide particles suspended in a polymer binder. The invention augments the power of the air blast by use of the Richtmyer-Meshkov instability, which is created by the voids, which are concave to the explosive at the explosive-reactive liner interface. The preferred geometry is a semi-cylindrical void. This geometry maximizes the reactive liner mixing, and prevents the case from prematurely failing. As the turbulent mixing generated by the semi-cylindrical voids is unstable, it defocuses the stresses as the case wall expands. The defocused stresses prevent premature case rupture, as in Pearson notches, allowing the case to expand to nearly its full extent before fracturing. As a result of the nearly full expansion, the fragments achieve higher ejection velocity than a typically lined generic warhead. And as result of the turbulent mixing, the blast peak pressure and maximum impulse are higher than typically lined generic warheads, as well.

The design of the sculpted reactive liner is based on proportion. The inside diameter of the reactive liner is ⅚th of the inside diameter of the bomb case. The semi-cylindrical voids have a preferred diameter of 1/12th of the outside diameter of the generic warhead. The voids are made such that the center of the cylindrical cut is at the interface of the explosive and reactive liner. The number of voids preferred is 3 times the inside diameter, measured in inches, of the case. The voids are spaced evenly at twice their radius and run axially along its length.

The instability is caused by passing a shock wave through two materials of two different acoustic impedances. This results in the growth of interfacial shock wave and rarefaction wave perturbations, which produces the instability.

Importantly, the applicant has found that Sculpted Reactive Liners have produced fragments that move from 5-20% faster in the beam spray than fragments produced using typical liners. There are also more fragments in the beam spray and their mass is more uniformly distributed Example 1

Table 1, below, indicates a preferred example of the notional mass, dimensions and other engineering information required by the warhead designer.

TABLE 1

Exemplary Warhead Design Table

| Bomb Parameter | inches |
|---|---|
| Case Height | 36.00 |
| Case Outside Diameter | 6.00 |
| Case Wall thickness | 0.33 |
| Case Inside Diameter | 5.35 |
| Reactive Liner Height | 36.00 |
| Reactive Liner Outside Diameter | 5.35 |
| Reactive Liner Thickness | 0.47-0.25 |
| Reactive Liner Inside Diameter | 4.41 |
| Number of Voids | 16 |
| Void Radius | 0.24 |
| Case Volume | 208.59 |
| Reactive Liner Volume | 208.30 |
| Explosive Volume | 548.64 |

Having thus described exemplary embodiments of the present invention, it should be noted by those skilled in the art that the disclosures herein are exemplary only and that alternatives, adaptations and modifications may be made within the scope of the present invention.

What is claimed is:

1. A blast enhancing reactive liner for a general purpose bomb containing an explosive located in a central axial cavity, said blast enhancing reactive liner comprising semi-cylindrical linear open cells that form semi-cylindrical voids located axially along an interior surface of said blast enhancing reactive liner such that at least a portion of said semi-cylindrical voids is open toward the explosive in the central axial cavity.

2. The blast enhancing reactive liner of claim 1 in which said semi-cylindrical voids in said blast enhancing reactive liner are concave to the explosive.

3. The blast enhancing reactive liner of claim 2 wherein said semi-cylindrical voids in said blast enhancing reactive liner are placed at an interface of said blast enhancing reactive liner and the explosive.

4. The blast enhancing reactive liner of claim 3 wherein said semi-cylindrical voids in said blast enhancing reactive liner have a radius that is $1/12^{th}$ of a radius of an outside diameter of the general purpose bomb.

5. The blast enhancing reactive liner of claim 1, wherein the number of said semi-cylindrical voids linear open cells is about three times an inside diameter of the general purpose bomb and wherein said semi-cylindrical linear open cells are evenly spaced.

6. The blast enhancing reactive liner of claim 1, in which said blast enhancing reactive liner is made from metal or metal oxide particles suspended in a thermoplastic matrix.

7. The blast enhancing reactive liner of claim 6, in which said blast enhancing reactive liner is manufactured by melt casting techniques.

8. The blast enhancing reactive liner of claim 1, wherein said blast enhancing reactive liner creates shear induced mixing in the form of a Richtmyer-Meshkov instability.

9. A bomb comprising a casing wall, an explosive located in a central axial cavity, and a blast enhancing reactive liner, said blast enhancing reactive liner having reversed notches comprising semi-cylindrical linear open cells that form semi-cylindrical voids located axially along an interior surface of said blast enhancing reactive liner such that at least a portion of said semi-cylindrical voids is open toward the explosive in the central axial cavity.

10. The bomb of claim 9 wherein said reactive liner produces more abundant and faster-moving fragments than typical annular surrounds or liners.

11. The bomb of claim 9 wherein said reactive liner creates shear induced mixing in the form of a Richtmyer-Meshkov instability which enhances blast without the need for ground reflections.

12. The bomb of claim 9, in which said reactive liner is made from thermoplastic polyethylene compounds containing suspended particles of metal or metal oxides.

13. The bomb of claim 9 wherein the reversed notches are placed at the interface of the liner and the explosive.

14. The bomb of claim 13 wherein the reversed notches have a radius that is $1/12^{th}$ of the radius of the outside diameter of the general purpose bomb.

15. The bomb of claim 13, wherein the number of semi-cylindrical linear open cells is about three times the inside diameter, measured in inches, of the general purpose bomb and wherein the open cells are evenly spaced.

* * * * *